US009796549B2

(12) United States Patent
Hayashi

(10) Patent No.: US 9,796,549 B2
(45) Date of Patent: Oct. 24, 2017

(54) PAPER GUIDING MECHANISM AND IMAGE FORMING DEVICE

(71) Applicant: Funai Electric Co., Ltd., Daito-shi, Osaka (JP)

(72) Inventor: Akira Hayashi, Kakogawa (JP)

(73) Assignee: Funai Electric Co., Ltd., Daito-shi (JP)

( * ) Notice: Subject to any disclaimer, the term of this patent is extended or adjusted under 35 U.S.C. 154(b) by 0 days.

(21) Appl. No.: 14/781,483

(22) PCT Filed: Feb. 17, 2014

(86) PCT No.: PCT/JP2014/053666

§ 371 (c)(1),
(2) Date: Sep. 30, 2015

(87) PCT Pub. No.: WO2014/162785

PCT Pub. Date: Oct. 9, 2014

(65) Prior Publication Data

US 2016/0052739 A1 Feb. 25, 2016

(30) Foreign Application Priority Data

Apr. 1, 2013 (JP) ..... 2013-076356

(51) Int. Cl.
*B65H 1/00* (2006.01)
*B65H 9/04* (2006.01)
*B65H 1/04* (2006.01)

(52) U.S. Cl.
CPC ..... *B65H 9/04* (2013.01); *B65H 1/04* (2013.01); *B65H 2405/121* (2013.01); *B65H 2511/12* (2013.01); *B65H 2511/20* (2013.01)

(58) Field of Classification Search
CPC ..... B65H 2511/12; B65H 2701/1131; B65H 1/04; B65H 1/00; B65H 2405/00;
(Continued)

(56) References Cited

U.S. PATENT DOCUMENTS 7,134,657 B2 * 11/2006 Yanagi ..... B65H 3/0661 271/171
8,246,045 B2 * 8/2012 Kubo ..... B65H 1/266 271/145
(Continued)

FOREIGN PATENT DOCUMENTS

JP 3-85329 U 8/1991
JP 6-115716 A 4/1994
(Continued)

OTHER PUBLICATIONS

Machine translation of JP 7-285681.*
(Continued)

*Primary Examiner* — Thomas Morrison
(74) *Attorney, Agent, or Firm* — Crowell & Moring LLP

(57) ABSTRACT

This paper guiding mechanism (110) includes a base member (1) including a placing surface (11) for placing papers (200) thereon and a base-side lock portion (12) and a paper guide member (2), while the paper guide member includes a paper aligning portion (21) coming into contact with the papers, a guide-side lock portion (22) locked to the base-side lock portion, and a lever portion (23) canceling a locked state of the guide-side lock portion with respect to the base-side lock portion and maintaining an unlocked state when the paper aligning portion is slidingly moved.

17 Claims, 9 Drawing Sheets

(58) Field of Classification Search
CPC ..... B65H 2405/1116; B65H 2405/112; B65H 2405/113; B65H 2405/114; B65H 2511/10; B65H 2405/121; B65H 2511/20
USPC ..... 271/171
See application file for complete search history.

(56) References Cited

U.S. PATENT DOCUMENTS

| | | | | |
|---|---|---|---|---|
| 2008/0179820 | A1 | 7/2008 | Kawamura et al. | |
| 2009/0322014 | A1 | 12/2009 | Imai | |
| 2012/0056370 | A1* | 3/2012 | Kobayashi ..... | B65H 1/266 271/250 |

FOREIGN PATENT DOCUMENTS

| | | | |
|---|---|---|---|
| JP | 7-285681 | * | 10/1995 |
| JP | 7-285681 | A | 10/1995 |
| JP | 10-129848 | A | 5/1998 |
| JP | 11-116069 | A | 4/1999 |
| JP | 3060472 | U | 6/1999 |
| JP | 3069307 | U | 3/2000 |
| JP | 2002-255360 | A | 9/2002 |
| JP | 2009-73574 | A | 4/2009 |
| JP | 2010-6596 | A | 1/2010 |

OTHER PUBLICATIONS

International Search Report (PCT/ISA/210) issued in counterpart International Application No. PCT/JP2014/053666 dated May 20, 2014, with English translation (Five (5) pages).

Japanese language Written Opinion issued in counterpart International Application No. PCT/JP2014/053666 dated May 20, 2014 (Three (3) pages).

* cited by examiner

PAPER GUIDING MECHANISM AND IMAGE FORMING DEVICE

TECHNICAL FIELD

The present invention relates to a paper guiding mechanism and an image forming device, and more particularly, it relates to a paper guiding mechanism and an image forming device each including a slidingly movable paper guide member.

BACKGROUND ART

A paper guiding mechanism including a slidingly movable paper guide member is known in general. Such a paper guiding mechanism is disclosed in Japanese Patent Laying-Open No. 7-285681, for example.

In the aforementioned Japanese Patent Laying-Open No. 7-285681, there is disclosed a paper feed cassette (a paper guiding mechanism) including a paper placing plate (a base member) including a placing surface for placing papers thereon and a lock groove (a base-side lock portion) provided to extend in a prescribed direction along the placing surface and a paper guide member mounted to be slidingly movable in the prescribed direction with respect to the paper placing plate. A paper cassette includes a guide portion (a paper aligning portion) formed to extend in an upper direction with respect to the placing surface of the paper placing plate for coming into contact with edge portions of the papers placed on the placing surface of the paper placing plate. Further, the paper cassette includes a pressing lever having a lock projection (a guide-side lock portion) locked to the lock groove of the paper placing plate. An elastic portion held by two notches extending in the upper direction with respect to the placing surface of the paper placing portion is formed on the guide portion. The guide portion and the pressing lever portion are configured to be connected with each other through the elastic portion. This paper cassette is configured to upwardly lift the lock projection on the lower portion of the pressing lever for canceling a locked state of the lock projection with respect to the lock groove by inclining the pressing lever toward the guide portion when placing large-sized papers. Further, the paper cassette is configured to be adjustable to a size suiting the large-sized papers through the guide portion slidingly moved to the side of the pressing lever in an unlocked state where the aforementioned locked state is canceled.

PRIOR ART

Patent Document

Patent Document 1: Japanese Patent Laying-Open No. 7-285681

SUMMARY OF THE INVENTION

Problem to be Solved by the Invention

In the paper cassette according to the aforementioned Japanese Patent Laying-Open No. 7-285681, however, there is such a case that the elastic portion between the guide portion and the pressing lever portion is so deflection-deformed that the upwardly lifted lock projection lowers to hit the lock groove when the guide portion is slidingly moved to a side where large-sized papers are placeable in the unlocked state. Therefore, there is such a problem that the lock projection of the paper guide member and the lock groove of the paper placing plate are caught by each other (the unlocked state cannot be maintained) and hence there is a case where the paper guide member cannot be smoothly moved to the side where the large-sized papers are placeable.

The present invention has been proposed in order to solve the aforementioned problem, and one object of the present invention is to provide a paper guiding mechanism and an image forming device each capable of smoothly moving a paper guide member to a side where large-sized papers are placeable with respect to a base member.

Means for Solving the Problem

A paper guiding mechanism according to a first aspect of the present invention includes a base member including a placing surface for placing papers thereon and a base-side lock portion provided to extend in a prescribed direction along the placing surface and a paper guide member mounted to be slidingly movable in the prescribed direction with respect to the base member, while the paper guide member includes a paper aligning portion formed to extend in an upper direction with respect to the placing surface of the base member for coming into contact with edge portions of the papers placed on the placing surface of the base member, a guide-side lock portion formed on a lower portion of the paper aligning portion to be locked to the base-side lock portion of the base member and an unlocking maintaining portion canceling a locked state of the guide-side lock portion with respect to the base-side lock portion by upwardly lifting the paper aligning portion provided with the guide-side lock portion on the lower portion and maintaining an unlocked state when the paper aligning portion is slidingly moved in the unlocked state where the locked state is canceled.

In the paper guiding mechanism according to the first aspect of the present invention, as hereinabove described, the guide-side lock portion formed on the lower portion of the paper aligning portion to be locked to the base-side lock portion of the base member and the unlocking maintaining portion canceling the locked state of the guide-side lock portion with respect to the base-side lock portion by upwardly lifting the paper aligning portion provided with the guide-side lock portion on the lower portion and maintaining the unlocked state when the paper aligning portion is slidingly moved in the unlocked state where the locked state is canceled are so provided that it is possible to inhibit the guide-side lock portion upwardly lifted by the unlocking maintaining portion from lowering and hitting the base-side lock portion (to maintain the unlocked state) when the paper guide member is slidingly moved to a side where large-sized papers are placeable, whereby the guide-side lock portion of the paper guide member and the base-side lock portion of the base member can be inhibited from being caught by each other. Thus, the paper guide member can be smoothly moved to the side where large-sized papers are placeable with respect to the base member. Consequently, operability of the paper guide member can be improved. Further, the guide-side lock portion locked to the base-side lock portion of the base member is so provided on the lower portion of the paper aligning portion that locking of the guide-side lock portion and the base-side lock portion can be inhibited from being canceled due to deformation of an elastic portion caused by a load from the papers in the locked state also in a case where the number of placed papers is large or in a case where the papers are firm (stiff), dissimilarly to a case of providing the guide-side lock portion on a lower portion of the unlocking maintaining portion from the paper aligning portion through the elastic portion. Thus, the paper guide member can be inhibited from slipping off in the locked state.

Preferably in the aforementioned paper guiding mechanism according to the first aspect, the unlocking maintaining portion includes a lever portion having a lift portion upwardly lifting the paper aligning portion provided with the guide-side lock portion on the lower portion by inclining while coming into contact with the base member and a grasp portion grasped when inclining the lift portion while bringing the lift portion into contact with the base member, and a contact portion of the lift portion coming into contact with the base member when the lever portion inclines is arranged downward beyond a lower end of the guide-side lock portion in the unlocked state. When structuring the paper guiding mechanism in this manner, the paper aligning portion provided with the guide-side lock portion on the lower portion can be easily upwardly lifted by moving the lift portion downward beyond the lower end of the guide-side lock portion with the lever portion (the grasp portion), whereby operability at the time of lifting up the paper aligning portion can be improved. Further, an interval between the guide-side lock portion of the lifted paper guide member and the base-side lock portion of the base member can be maintained due to the contact portion of the lift portion, whereby the guide-side lock portion and the base-side lock portion can be reliably inhibited from being caught by each other.

Preferably in this case, the contact portion of the lift portion is arranged on a position separating to an outer side opposite to a side of the paper aligning portion coming into contact with the papers beyond the guide-side lock portion. When structuring the paper guiding mechanism in this manner, force in a sliding movement direction applied to the paper aligning portion can be received by the contact portion of the lift portion when slidingly moving the paper aligning portion toward the outer side (the side where large-sized papers are placeable) opposite to the side of the paper aligning portion coming into contact with the papers beyond the guide-side lock portion, whereby the guide-side lock portion can be effectively inhibited from lowering and hitting the base-side lock portion.

Preferably in the aforementioned structure including the lever portion, the grasp portion is arranged to be opposed to the paper aligning portion in the locked state, and an upper portion of the grasp portion inclines in a direction approaching the paper aligning portion and comes into contact with the paper aligning portion while the lift portion coming into contact with the base member inclines following inclination of the grasp portion thereby lifting up the guide-side lock portion in the unlocked state, and the contact portion of the lift portion coming into contact with the base member is slidingly movable in a state maintaining a prescribed angle of inclination with respect to the base portion in the unlocked state. When structuring the paper guiding mechanism in this manner, the paper guide member is slidingly moved while the state where the contact portion of the lift portion inclines by the prescribed angle of inclination with respect to the base member at the time when the guide-side lock portion is lifted up is maintained, whereby the interval between the lifted guide-side lock portion and the base-side lock portion can be more reliably maintained also at the time of slidingly moving the paper guide member. Thus, the guide-side lock portion of the paper guide member and the base-side lock portion of the base member can be more reliably inhibited from being caught by each other.

Preferably in the aforementioned structure in which the contact portion is slidingly movable in the state maintaining the prescribed angle of inclination with respect to the base member, the paper guide member is slidingly movable in a state where the contact portion maintains the prescribed angle of inclination with respect to the base member while the paper aligning portion, the lift portion and the grasp portion maintain relative positional relation in the unlocked state. When structuring the paper guiding mechanism in this manner, the paper guide member is slidingly moved while the state where the contact portion of the lift portion inclines by the prescribed angle of inclination with respect to the base member and the relative positional relation between the paper aligning portion, the lift portion and the grasp portion at the time when the guide-side lock portion is lifted up are maintained, whereby the interval between the lifted guide-side lock portion and the base-side lock portion can be more reliably maintained also at the time of slidingly moving the paper guide member. Thus, the guide-side lock portion of the paper guide member and the base-side lock portion of the base member can be more reliably inhibited from being caught by each other.

Preferably in the aforementioned structure in which the paper guide member is slidingly movable in the state where the paper aligning portion, the lift portion and the grasp portion maintain the relative positional relation, the paper aligning portion, the grasp portion and the lift portion have thicknesses substantially undeformed in the unlocked state. When structuring the paper guiding mechanism in this manner, the paper guide member can be slidingly moved in such a state that the state where the contact portion of the lift portion inclines by the prescribed angle of inclination with respect to the base member and the relative positional relation between the paper aligning portion, the lift portion and the grasp portion at the time when the guide-side lock portion is lifted up are reliably maintained.

Preferably in the aforementioned structure including the lever portion, the guide-side lock portion of the paper guide member includes a guide-side pawl portion whose forward end has a prescribed angle, and the lift portion inclines by an angle smaller than the prescribed angle of the guide-side pawl portion with respect to the base member in the unlocked state. When structuring the paper guiding mechanism in this manner, the lift portion can be inhibited from excessively inclining with respect to the base member in the unlocked state, whereby the lift portion (the lever portion) can be inhibited from being caught by the base member when slidingly moving the paper guide member.

Preferably in the aforementioned structure in which the contact portion is slidingly movable in the state maintaining the prescribed angle of inclination with respect to the base member, the base-side lock portion of the base member includes a base-side pawl portion, the guide-side lock portion of the paper guide member includes a guide-side pawl portion, and the paper aligning portion is upwardly lifted to be arranged on a height position where the guide-side pawl portion of the guide-side lock portion does not come into contact with the base-side pawl portion of the base-side lock portion in the unlocked state. When structuring the paper guiding mechanism in this manner, the lifted guide-side lock portion (the guide-side pawl portion) and the base-side lock portion (the base-side pawl portion) can be reliably inhibited from being caught by each other when slidingly moving the paper guide member.

Preferably in the aforementioned structure including the lever portion, the grasp portion shifts the locked state to the unlocked state by being inclined toward the side of the paper aligning portion while bringing the lift portion into contact with the base member and shifts the unlocked state to the locked state by being separated from the side of the paper aligning portion and arranged substantially perpendicularly with respect to the base member. When structuring the paper guiding mechanism in this manner, the unlocked state and the locked state can be easily switched by changing the inclined state of the grasp portion with respect to the paper aligning portion.

Preferably in the aforementioned structure in which the contact portion is slidingly movable in the state maintaining the prescribed angle of inclination with respect to the base member, the lever portion is formed substantially in an L shape by the lift portion positioned on a lower portion and the grasp portion extending in an upper direction intersecting with respect to the lift portion, the paper guide member includes a connecting portion connecting the lever portion formed substantially in the L shape and the paper aligning portion with each other, and a torsion-deformable lever support portion pivotably supporting the lever portion is provided on a region of the connecting portion in the vicinity of the lever portion, while the lift portion of the lever portion pivots on the lever support portion to lift up the paper aligning portion and is inclined in the unlocked state. When structuring the paper guiding mechanism in this manner, the lever portion can be easily inclined (pivoted) by torsion-deforming the lever support portion, whereby the paper aligning portion provided with the guide-side lock portion on the lower portion can be more easily upwardly lifted.

Preferably in the aforementioned structure including the L-shaped lever portion, a surface of the lift portion on the side of the base member is formed in a plate shape substantially in the form of a planar surface. When structuring the paper guiding mechanism in this manner, friction between the surface of the lift portion on the side of the base member and the base member can be reduced, whereby the paper guide member can be smoothly slidingly moved.

Preferably in the aforementioned structure including the L-shaped lever portion, the lever support portions are provided in a pair, and the pair of lever support portions hold the lever portion therebetween in plan view. When structuring the paper guiding mechanism in this manner, the lever portion can be inclined in a stable state by torsion-deforming the pair of lever support portions.

Preferably in the aforementioned structure including the L-shaped lever portion, the lever support portion has a width smaller than the width of the connecting portion in plan view. When structuring the paper guiding mechanism in this manner, the lever support portion can be easily torsion-deformed, whereby the lever portion can be more easily inclined.

Preferably in the aforementioned structure in which the lever portion is formed substantially in an L shape, the paper guide member is formed by resin, and the paper aligning portion, the connecting portion and the lever portion are integrally formed. When structuring the paper guiding mechanism in this manner, increase in the number of components can be suppressed, dissimilarly to a case of separately providing the paper aligning portion, the connecting portion and the lever portion respectively. Further, the paper aligning portion, the connecting portion and the lever portion can be easily simultaneously integrally formed by resin formation.

Preferably in the aforementioned structure including the lever portion, the paper guide member further includes a load portion provided adjacently to the paper aligning portion to be loaded with the papers and a back surface arrangement portion provided to couple to the load portion and arranged on a back surface of the base member, and a hinge portion deflection-deformable in a direction for upwardly lifting the load portion and the paper aligning portion is provided in the vicinity of the boundary between the back surface arrangement portion and the load portion. When structuring the paper guiding mechanism in this manner, the paper aligning portion provided with the guide-side lock portion on the lower portion can be easily upwardly lifted by deflecting a vicinity of the hinge portion of the back surface arrangement portion.

Preferably in the aforementioned structure including the back surface arrangement portion, the back surface arrangement portion has a horizontally long shape extending in a direction where the paper aligning portion slidingly moves, and at least parts of the lift portion and the grasp portion are arranged to overlap with the back surface arrangement portion in a short-side direction of the back surface arrangement portion having the horizontally long shape. When structuring the paper guiding mechanism in this manner, the back surface arrangement portion can be inhibited from being distorted around a straight line passing through the back surface arrangement portion and substantially parallel to the extensional direction of the back surface arrangement portion, dissimilarly to a case where the lift portion and the grasp portion are arranged on positions remarkably separating from the back surface arrangement portion in the short-side direction of the back surface arrangement portion. Thus, a vicinity of the hinge portion of the back surface arrangement portion can be easily upwardly deflected.

Preferably in this case, the back surface arrangement portion includes a first restriction portion and a second restriction portion capable of restricting lifting of the paper aligning portion provided with the guide-side lock portion on the lower portion beyond a prescribed height by coming into contact with the back surface of the base member, the first restriction portion is formed on a position closer to the hinge portion than the second restriction portion, and an upper surface of the first restriction portion is arranged upward beyond an upper surface of the second restriction portion. When structuring the paper guiding mechanism in this manner, the back surface arrangement portion can be inhibited from breakage due to excessive upward lifting of the paper aligning portion through the first restriction portion and the second restriction portion. Further, the paper aligning portion is upwardly lifted by the difference between the heights of the upper surface of the first restriction portion and the upper surface of the second restriction portion, whereby the quantity of lifting of the paper aligning portion can be easily restricted.

Preferably in the aforementioned structure including the first restriction portion and the second restriction portion, the base-side lock portion of the base member includes a base-side pawl portion, the guide-side lock portion of the paper guide member includes a guide-side pawl portion, the first restriction portion comes into contact with the base member in the locked state and the unlocked state, the second restriction portion is arranged on a position between the first restriction portion and the guide-side pawl portion of the paper guide member in a direction where the paper aligning portion slidingly moves, and the interval between the upper surface of the first restriction portion and the upper surface of the second restriction portion is larger than the length of the base-side pawl portion in the vertical direction. When structuring the paper guiding mechanism in this manner, the paper aligning portion can be easily upwardly lifted by the difference between the heights of the upper surface of the first restriction portion and the upper surface of the second restriction portion by employing the first restriction portion as the fulcrum, dissimilarly to a case where the second restriction portion is arranged on a side opposite to the first restriction portion beyond the guide-side pawl portion of the paper guide member.

Preferably in the aforementioned structure including the first restriction portion and the second restriction portion, the first restriction portion and the second restriction portion are formed integrally with the back surface arrangement portion. When structuring the paper guiding mechanism in this manner, the number of components can be reduced, dissimilarly to a case of structuring the first restriction portion and the second restriction portion separately from the back surface arrangement portion.

An image forming device according to a second aspect of the present invention includes a printing portion performing printing on papers, a base member including a placing surface for placing the papers thereon and a base-side lock portion provided to extend in a prescribed direction along the placing surface and a paper guide member mounted to be slidingly movable in the prescribed direction with respect to the base member, while the paper guide member includes a paper aligning portion formed to extend in an upper direction with respect to the placing surface of the base member for coming into contact with edge portions of the papers placed on the placing surface of the base member, a guide-side lock portion formed on a lower portion of the paper aligning portion to be locked to the base-side lock portion of the base member, and an unlocking maintaining portion canceling a locked state of the guide-side lock portion with respect to the base-side lock portion by upwardly lifting the paper aligning portion provided with the guide-side lock portion on the lower portion and maintaining an unlocked state when the paper aligning portion is slidingly moved in the unlocked state where the locked state is canceled.

In the image forming device according to the second aspect of the present invention, as hereinabove described, the guide-side lock portion formed on the lower portion of the paper aligning portion to be locked to the base-side lock portion of the base member and the unlocking maintaining portion canceling the locked state of the guide-side lock portion with respect to the base-side lock portion by upwardly lifting the paper aligning portion provided with the guide-side lock portion on the lower portion and maintaining the unlocked state when the paper aligning portion is slidingly moved in the unlocked state where the locked state is canceled are so provided that it is possible to inhibit the guide-side lock portion upwardly lifted by the unlocking maintaining portion from lowering and hitting the base-side lock portion (to maintain the unlocked state) when the paper guide member is slidingly moved to a side where large-sized papers are placeable, whereby the guide-side lock portion of the paper guide member and the base-side lock portion of the base member can be inhibited from being caught by each other. Thus, the paper guide member can be smoothly moved to the side where large-sized papers are placeable with respect to the base member. Consequently, operability of the paper guide member can be improved. Further, the guide-side lock portion locked to the base-side lock portion of the base member is so provided on the lower portion of the paper aligning portion that locking of the guide-side lock portion and the base-side lock portion can be inhibited from being canceled due to deformation of an elastic portion caused by a load from the papers in the locked state also in a case where the number of placed papers is large or in a case where the papers are firm (stiff), dissimilarly to a case of providing the guide-side lock portion on a lower portion of the unlocking maintaining portion from the paper aligning portion through the elastic portion. Thus, the paper guide member can be inhibited from slipping off in the locked state.

Effect of the Invention

According to the present invention, as hereinabove described, the paper guide member can be smoothly moved toward the side where large-sized papers are placeable with respect to the base member.

MODES FOR CARRYING OUT THE INVENTION

An embodiment of the present invention is now described on the basis of the drawings.

The structure of a printer device 100 according to the embodiment of the present invention is described with reference to FIGS. 1 to 11. The printer device 100 is an example of the "image forming device" in the present invention.

Figure 1:
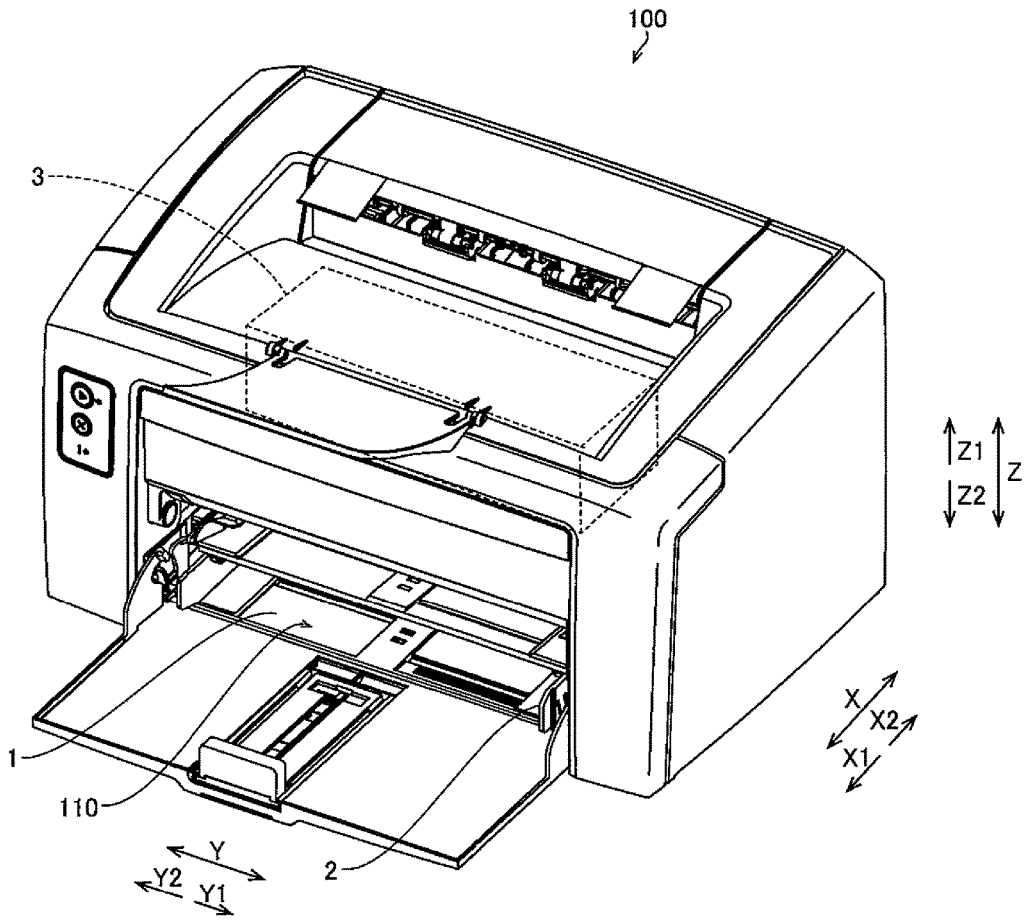
FIG. 1 A diagram showing the overall structure of a printer device according to an embodiment of the present invention.

The printer device 100 according to the embodiment of the present invention includes a base member 1 for placing papers 200 thereon, a paper guide member 2 for aligning the directions of the papers 200 and a developing device 3 performing printing on the papers 200, as shown in FIG. 1. The developing device 3 includes a photosensitive drum for performing printing by sticking toner to the papers 200, a transfer roller for transferring the toner adhering to the photosensitive drum to the papers and the like. The papers 200 placed on the paper guide member 2 are configured to be transported to the developing device 3. The developing device 3 is an example of the "printing portion" in the present invention.

Figure 2:
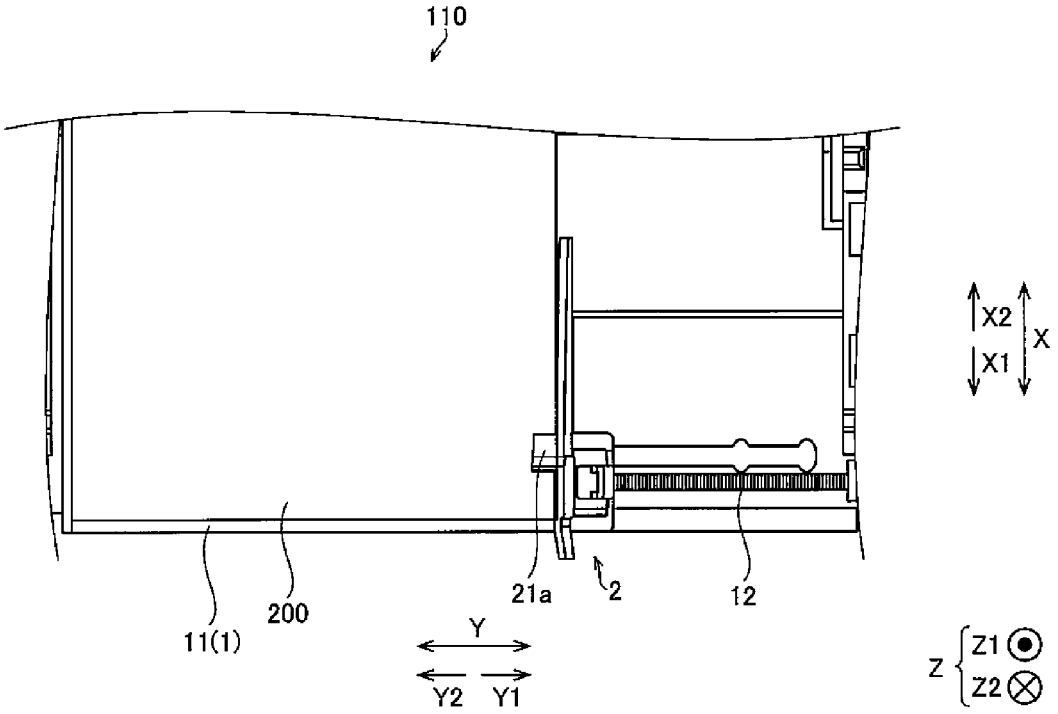
FIG. 2 A diagram showing a surface of a base member of the printer device according to the embodiment of the present invention.

According to this embodiment, a paper guiding mechanism 110 is constituted of the base member 1 and the paper guide member 2, a shown in FIGS. 1 and 2. The paper guiding mechanism 110 is configured to be mountable in the inner portion of the printer device 100.

Figure 3:
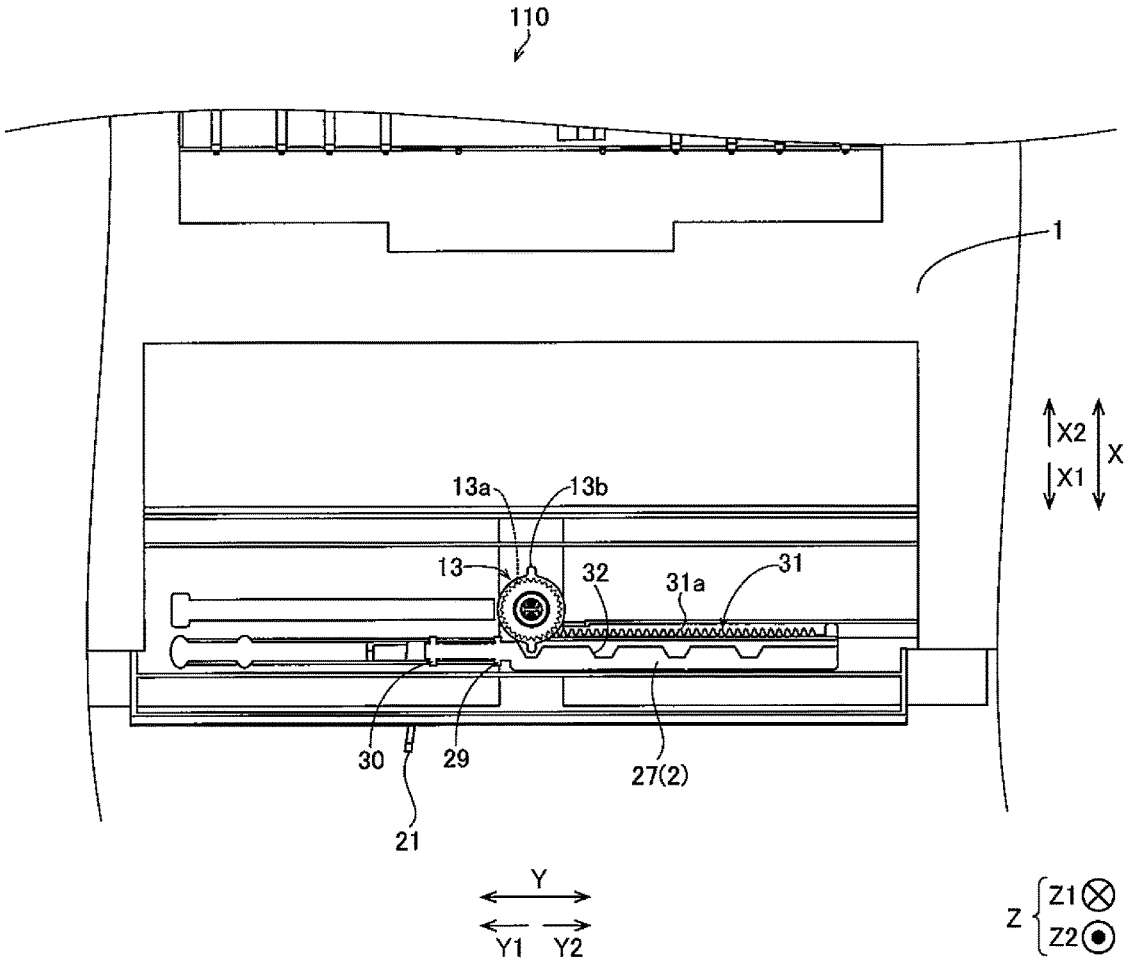
FIG. 3 A diagram showing a back surface of the base member of the printer device according to the embodiment of the present invention.
Figure 8:
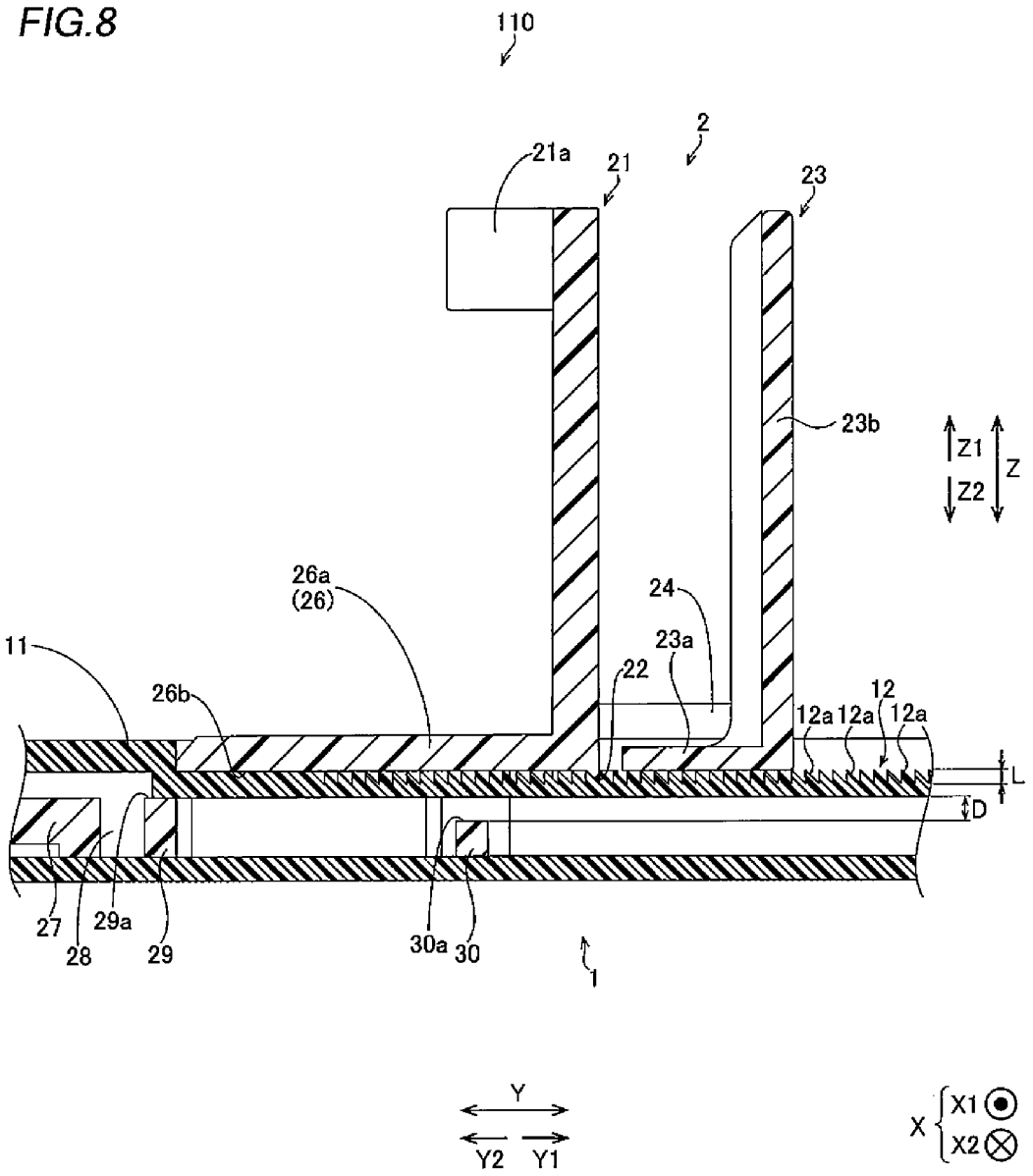
FIG. 8 A diagram showing a locked state of the printer device according to the embodiment of the present invention.
Figure 10:
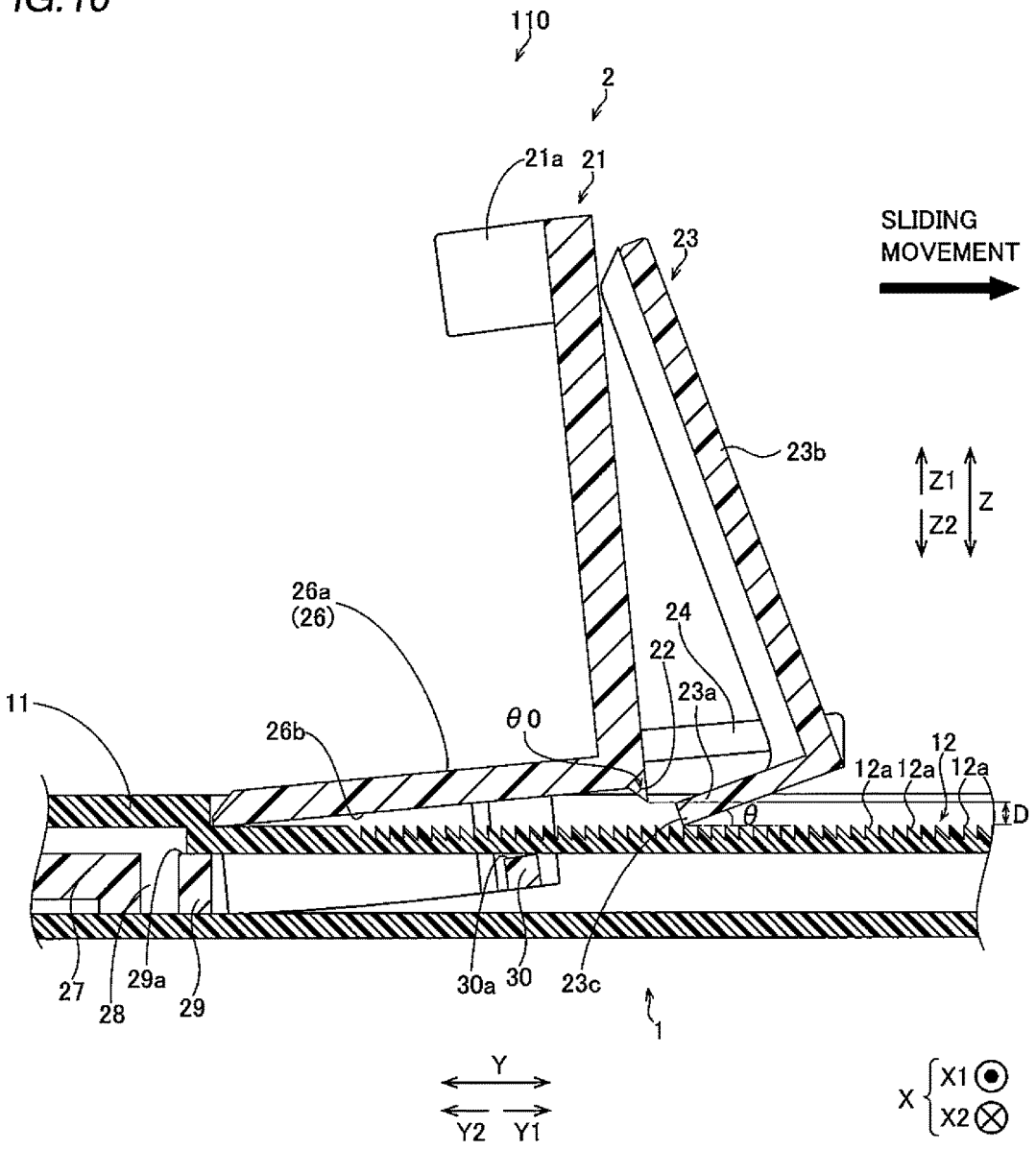
FIG. 10 A diagram showing an unlocked state of the printer device according to the embodiment of the present invention.

The base member 1 includes a placing surface 11 for placing the papers 200 thereon and a base-side lock portion 12 provided to extend in a Y direction along the placing surface 11, as shown in FIG. 2. The placing surface 11 is so configured that the papers 200 of a prescribed size are placeable thereon. The base-side lock portion 12 includes a plurality of pawl portions 12*a*, as shown in FIGS. 8 and 10. The pawl portions 12*a* are so formed that sections thereof have substantially triangular shapes as viewed from an X direction. The pawl portions 12*a* have a length (a height) L in a Z direction. The base member 1 includes a rotary portion 13 including a pinion portion 13*a* on a back surface (the side of a Z2 direction), as shown in FIG. 3. The rotary portion 13 includes a pair of projecting portions 13*b* in the diametral direction. The pawl portions 12*a* are examples of the "base-side pawl portion" in the present invention.

According to this embodiment, the paper guide member 2 is configured to be mounted to be slidingly movable in the Y direction with respect to the base member 1, as shown in FIG. 2. The paper guide member 2 includes a paper aligning portion 21 aligning the directions of the papers 200 and a guide-side lock portion 22 (see FIG. 7) locked to the base-side lock portion 12 (see FIG. 2) of the base member 1, as shown in FIGS. 4 to 7. Further, the paper guide member 2 includes a lever portion 23 canceling a locked state of the guide-side lock portion 22 with respect to the base-side lock portion 12. In addition, the paper guide member 2 includes connecting portions 24 connecting the lever portion 23 and the paper aligning portion 21 with each other. Lever support portions 25 are provided on regions between the connecting portions 24 and the lever portion 23. Further, the paper guide member 2 includes a load portion 26 loaded with the papers 200 and a back surface arrangement portion 27 arranged on the back surface (the side of the Z2 direction) of the base member 1. The paper guide member 2 is integrally formed by resin.

Figure 4:
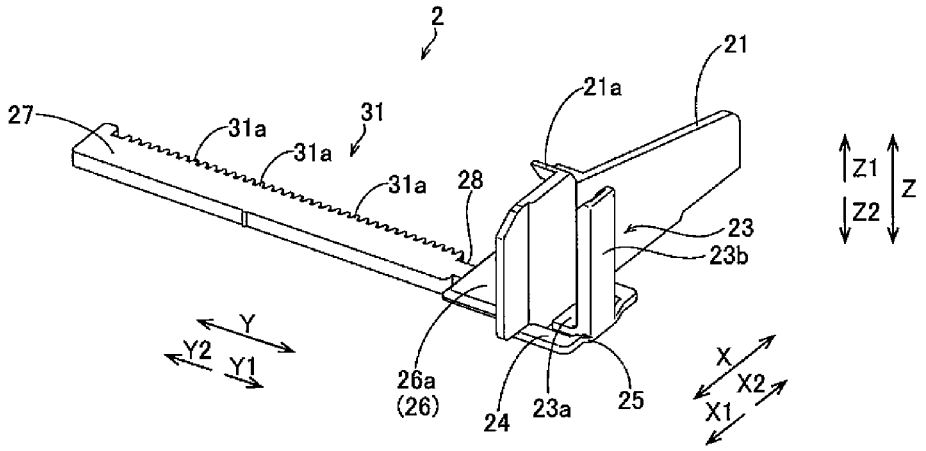
FIG. 4 A perspective view of a paper guide member of the printer device according to the embodiment of the present invention as viewed from the right side.
Figure 5:
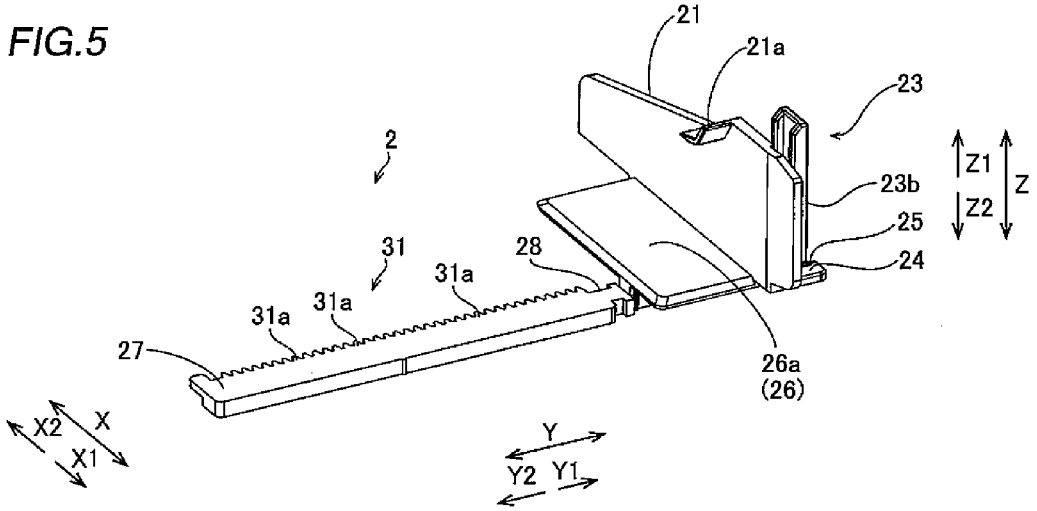
FIG. 5 A perspective view of the paper guide member of the printer device according to the embodiment of the present invention as viewed from the left side.

The paper aligning portion 21 is formed to extend in an upper direction (a Z1 direction) substantially perpendicularly with respect to the placing surface 11 (see FIG. 2) of the base member 1, as shown in FIGS. 4 to 7. Further, the paper aligning portion 21 is configured to come into contact with edge portions of the papers 200 placed on the placing surface 11 of the base member 1, as shown in FIG. 2. A floating inhibiting portion 21*a* inhibiting the papers 200 placed on the placing surface 11 of the base member 1 from floating up is provided on the upper side (the side of the Z1 direction) of the paper aligning portion 21, as shown in FIGS. 2, 4 and 5.

Figure 7:
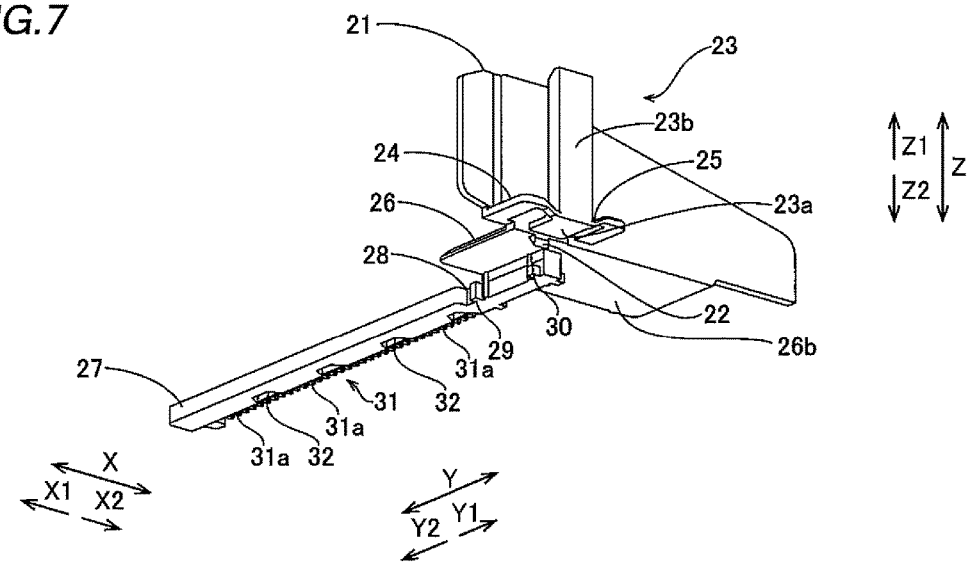
FIG. 7 A perspective view of the paper guide member of the printer device according to the embodiment of the present invention as viewed from the lower side.

One guide-side lock portion 22 is formed on a lower portion (the side of the Z2 direction) of the paper aligning portion 21, as shown in FIGS. 7 and 8. Further, the guide-side lock portion 22 is configured to be locked to the base-side lock portion 12 of the base member 1, as shown in FIG. 8. In addition, the guide-side lock portion 22 is formed on a position corresponding to the base-side lock portion 12 of the base member 1. Further, the guide-side lock portion 22 is provided in the form of a pawl. In other words, the guide-side lock portion 22 functions as a guide-side pawl portion whose forward end has a prescribed angle θ0 (see FIG. 10). The prescribed angle θ0 is a sharp angle. The guide-side lock portion 22 is formed to be substantially triangular as viewed from the X direction. Further, the guide-side lock portion 22 has the length L in the Z direction. In addition, the guide-side lock portion 22 is so configured that movement in a direction (a Y1 direction) for adjusting the paper guide member 2 with respect to large-sized papers is restricted. On the other hand, the guide-side lock portion 22 is so configured that movement in a direction (a Y2 direction) for adjusting the paper guide member 2 with respect to small-sized papers is possible.

The lever portion 23 includes a lift portion 23*a* positioned on a lower portion (the side of the Z2 direction) and a grasp portion 23*b* extending in the upper direction (the Z1 direction) intersecting with respect to the lift portion 23*a*, as shown in FIGS. 4 to 11. Further, the lever portion 23 is formed substantially in an L shape. More specifically, a surface (a lower surface in a locked state) of the lift portion 23*a* of the lever portion 23 on the side of the base member 1 is formed in a plate shape substantially in the form of a planar surface. The lift portion 23*a* and the grasp portion 23*b* are configured to intersect with each other at an angle of about 90 degrees. The lever portion 23 is arranged on a Y1-direction side of the paper aligning portion 21. Further, the lever portion 23 is configured to switch the guide-side lock portion 22 from the locked state (see FIG. 8) to the unlocked state (see FIG. 10) by being inclined toward the left side (the side of the Y2 direction). The lever portion 23 is an example of the "unlocking maintaining portion" in the present invention.

Figure 11:
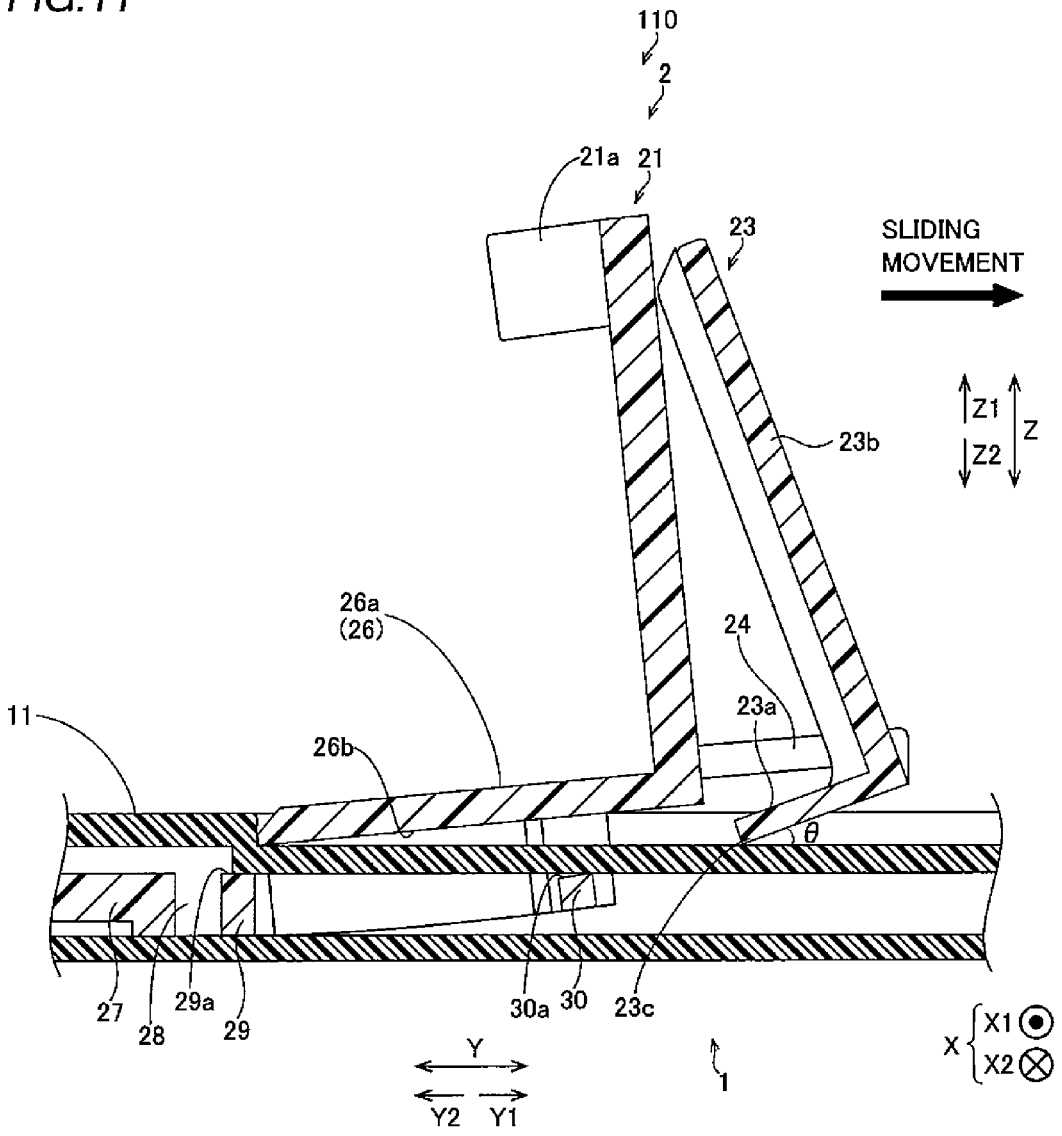
FIG. 11 A diagram showing the first restriction portion and the second restriction portion in the unlocked state of the printer device according to the embodiment of the present invention.

The lift portion 23*a* is configured to upwardly lift the paper aligning portion 21 provided with the guide-side lock portion 22 on the lower portion (the side of the Z2 direction) by inclining while coming into contact with the base member 1, as shown in FIGS. 10 and 11. Further, the lift portion 23*a* is so configured that a contact portion 23*c* of the lift portion 23*a* coming into contact with the base member 1 is arranged on a position separating to an outer side opposite (in the Y1 direction) to a side of the paper aligning portion 21 coming into contact with the papers beyond the guide-side lock portion 22 when the lever portion 23 inclines (pivots). The grasp portion 23*b* is configured to be arranged to be opposed to the paper aligning portion 21 in the locked state where the guide-side lock portion 22 and the base-side lock portion 12 of the base member 1 are locked to each other. Further, the grasp portion 23*b* is configured to be grasped when inclining the lift portion 23*a* while bringing the same into contact with the base member 1. The lift portion 23*a* is an example of the "unlocking maintaining portion" in the present invention. The grasp portion 23*b* is an example of the "unlocking maintaining portion" in the present invention.

The lever portion 23 is configured to cancel the locked state of the guide-side lock portion 22 with respect to the base-side lock portion 12 by lifting the paper aligning portion 21 provided with the guide-side lock portion 22 on the lower portion (the side of the Z2 direction) upward (in the Z1 direction), as shown in FIG. 10. More specifically, the lever portion 23 is so configured that an upper portion of the grasp portion 23*b* inclines in a direction (the Y2 direction) approaching the paper aligning portion 21 to come into contact with the paper aligning portion 21 in the unlocked state. Further, the lever portion 23 is so configured that the lift portion 23*a* coming into contact with the base member 1 inclines following inclination of the grasp portion 23*b* so that the guide-side lock portion 22 is lifted up. At this time, the paper aligning portion 21 is upwardly lifted to be arranged on a height position where the guide-side lock portion 22 (the guide-side pawl portion) in the form of a pawl does not come into contact with the pawl portions 12*a* of the base-side lock portion 12 in the unlocked state.

More detailedly, the paper guide member 2 is so configured that the lift portion 23*a* of the lever portion 23 pivots on the lever support portions 25 (see FIG. 4) to lift up the paper aligning portion 21 to be inclined in the unlocked state, as shown in FIG. 10. Further, the contact portion 23*c* of the lift portion 23*a* coming into contact with the base member 1 when the lever portion 23 inclines (pivots) is configured to be arranged downward (the side of the Z2 direction) beyond the lower end of the guide-side lock portion 22 in the unlocked state. The guide-side lock portion 22 is configured to be lifted up to a height where the locking with the base-side lock portion 12 of the base member 1 is canceled at this time. The lever portion 23 is configured to maintain the unlocked state when the paper aligning portion 21 is slidingly moved in the unlocked state.

The paper guide member 2 is configured to be slidingly movable in a state where the contact portion 23*c* of the lift portion 23*a* coming into contact with the base member 1 maintains a prescribed angle θ of inclination with respect to the base member 1 in the unlocked state, as shown in FIGS. 10 and 11. Further, the paper guide member 2 is configured to be slidingly movable in a state where the contact portion 23*c* maintains the prescribed angle θ of inclination with respect to the base member 1 while the paper aligning portion 21, the lift portion 23*a* and the grasp portion 23*b* maintain relative positional relation in the unlocked state. The lift portion 23*a* inclines by the angle θ smaller than the prescribed angle θ0 of the guide-side lock portion 22 (the guide-side pawl portion) with respect to the base member 1 in the unlocked state.

Figure 9:
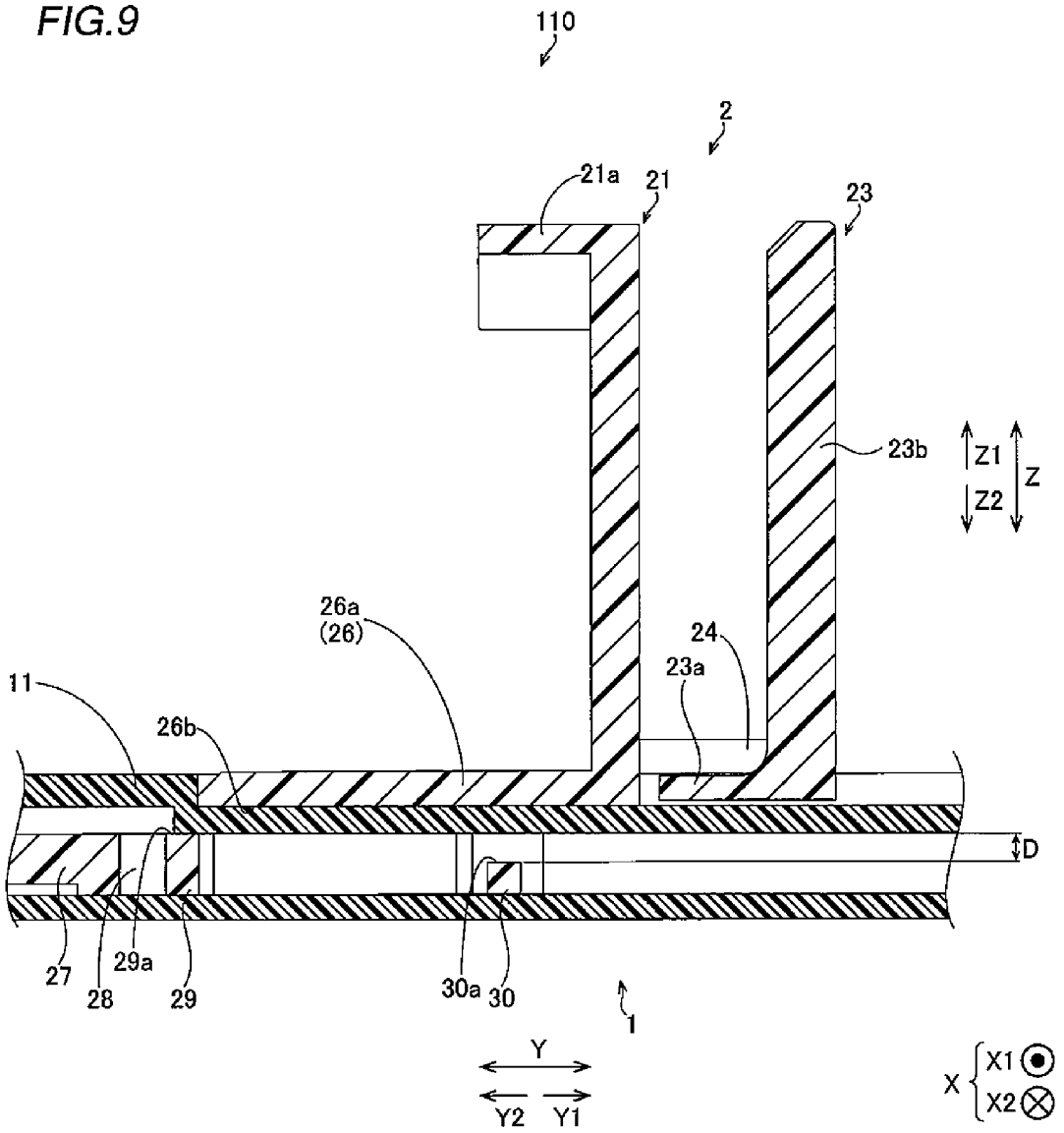
FIG. 9 A diagram showing a first restriction portion and a second restriction portion in the locked state of the printer device according to the embodiment of the present invention.

The connecting portions 24 are provided in a pair between the paper aligning portion 21 and the lever portion 23, as shown in FIGS. 4 and 7. Further, the connecting portions 24 are provided in the form of plates. The lift portion 23*a* (see FIG. 4) is configured to be arranged between the pair of connecting portions 24. The paper aligning portion 21, the connecting portions 24 and the lever portion 23 are integrally formed by resin. The connecting portions 24 are formed substantially parallelly with respect to the base-side lock portion 12 and the placing surface 11 of the base member 1, as shown in FIGS. 8 and 9.

Figure 6:
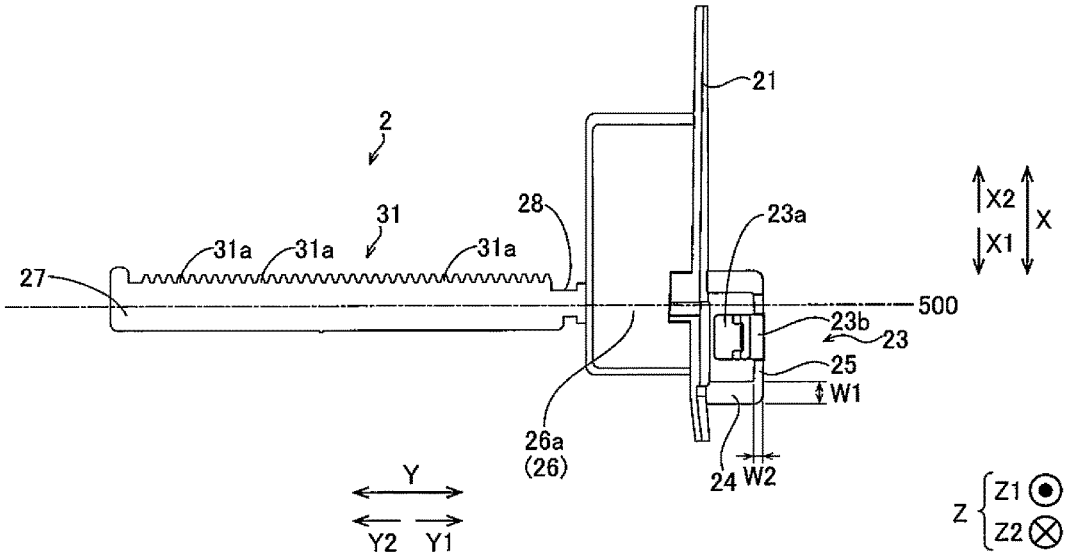
FIG. 6 A perspective view of the paper guide member of the printer device according to the embodiment of the present invention as viewed from the upper side.

The lever support portions 25 are provided as shown in FIGS. 4 to 7, and on regions of the connecting portions 24 in the vicinity of the lever portion 23. More specifically, the lever support portions 25 are provided in a pair between the connecting portions 24 and the lever portion 23. The pair of lever support portions 25 are configured to hold the lever portion 23 therebetween in plan view. Further, the lever support portions 25 have a width smaller than the width of the connecting portions 24 in plan view. Thus, the lever support portions 25 are configured to pivotably support the lever portion 23. Further, the lever support portions 25 are configured to be torsion-deformable when the lever portion 23 is inclined (pivoted). More specifically, the lever support portions 25 have a width W2, smaller than a width W1 of the connecting portions 24 in the X direction, in the Y direction, as shown in FIG. 6. The paper aligning portion 21, the lever portion 23 (the lift portion 23*a* and the grasp portion 23*b*), the connecting portions 24 and the load portion 26 are configured not to torsion-deform when the lever portion 23 is inclined (pivoted). More specifically, the paper aligning portion 21, the lever portion 23 (the lift portion 23*a* and the grasp portion 23*b*), the connecting portions 24 and the load portion 26 are formed to have prescribed thicknesses not torsion-deforming when the lever portion 23 is inclined (pivoted), in response to the resin constituting the paper guide member 2.

This paper guiding mechanism 110 is configured to shift the locked state to the unlocked state by inclining the grasp portion 23*b* toward the side of the paper aligning portion 21 (the side of the Y2 direction) (bringing the grasp portion 23*b* into contact with the side of the paper aligning portion 21) while bringing the lift portion 23*a* into contact with the base member 1. Further, the paper guiding mechanism 110 is so configured that the grasp portion 23*b* is separated from the paper aligning portion 21 and arranged substantially perpendicularly with respect to the base member 1 thereby shifting the unlocked state to the locked state.

The load portion 26 is provided to be adjacent to a surface of the paper aligning portion 21 on the side of the Y2 direction, as shown in FIGS. 4 to 7. Further, the load portion 26 is so configured that an upper surface 26*a* is substantially parallel with respect to the placing surface 11 of the base member 1, as shown in FIGS. 8 and 9.

The back surface arrangement portion 26 is provided to couple to a lower surface 26*b* (see FIG. 7) of the load portion 26, as shown in FIGS. 4 to 7. Further, the back surface arrangement portion 27 is configured to be arranged (see FIG. 3) on the back surface (the side of the Z2 direction) of the base member 1. In addition, the back surface arrangement portion 27 is formed in a substantially horizontally long shape extending toward the direction (the Y direction) where the paper aligning portion 21 slidingly moves. The lever portion 23 (the lift portion 23*a* and the grasp portion 23*b*) is arranged in the vicinity of a straight line 500 (see FIG. 6) substantially parallel to the extensional direction (the Y direction) of the back surface arrangement portion 27 passing through a hinge portion 28 of the back surface arrangement portion 27. More specifically, at least a part of the lever portion 23 (the lift portion 23*a* and the grasp portion 23*b*) is arranged to overlap with the back surface arrangement portion 27 in the short-side direction (the X direction) of the back surface arrangement portion 27. The back surface arrangement portion 27 includes the hinge portion 28 which is deflection-deformable as well as first restriction portions 29 (see FIG. 7) and second restriction portions 30 (see FIG. 7) restricting a height up to which the paper aligning portion 21 is lifted. Further, the back surface arrangement portion 27 includes a rack portion 31 having a plurality of pawl portions 31*a* on a side along the X2 direction. In addition, the back surface arrangement portion 27 includes a plurality of recess portions 32, as shown in FIGS. 3 and 7.

The hinge portion 28 is provided in the vicinity of the boundary between the back surface arrangement portion 27 and the load portion 26, as shown in FIGS. 4 to 7. The hinge portion 28 is formed by lessening the width of the back surface arrangement portion 27 in the X direction. Further, the hinge portion 28 is configured to be deflection-deformable in the direction lifting the load portion 26 and the paper aligning portion 21 upward (in the Z1 direction). As shown in FIGS. 10 and 11, the back surface arrangement portion 27 is so configured that a vicinity of the hinge portion 28 of the back surface arrangement portion 27 is deflected when the paper aligning portion 21 is upwardly lifted.

The first restriction portions 29 and the second restriction portions 30 are configured to be capable of restricting lifting of the paper aligning portion 21 provided with the guide-side lock portion 22 on the lower portion beyond a prescribed height by coming into contact with the back surface (the side of the Z2 direction) of the base member 1, as shown in FIGS. 8 to 11. Further, the first restriction portions 29 and the second restriction portions 30 are formed in single pairs respectively, as shown in FIG. 7. The pair of first restriction portions 29 are formed on positions opposed to each other. Further, the pair of first restriction portions 29 are formed to protrude toward the X1 direction and the X2 direction respectively. The pair of second restriction portions 30 are formed on positions opposed to each other. Further, the pair of second restriction portions 30 are formed to protrude toward the X1 direction and the X2 direction respectively. The first restriction portions 29 and the second restriction portions 30 are formed integrally with the back surface arrangement portion 27.

The first restriction portions 29 are formed on positions closer to the hinge portion 28 than the second restriction portions 30, as shown in FIGS. 8 to 11. Upper surfaces 29*a* of the first restriction portions 29 are formed to be arranged upward (the side of the Z1 direction) beyond upper surfaces 30*a* of the second restriction portions 30 in the locked state, as shown in FIGS. 8 and 9. Further, the first restriction portions 29 are configured to come into contact with the lower surface (the surface on the side of the Z2 direction) of the base member 1 in the locked state and the unlocked state. The second restriction portions 30 are arranged on positions between the first restriction portions 29 and the guide-side lock portion 22 (the guide-side pawl portion) of the paper guide member 21 in the direction (the Y direction) where the paper aligning portion 21 slidingly moves.

The first restriction portions 29 and the second restriction portions 30 are so formed that the upper surfaces 29*a* of the first restriction portions 29 and the upper surfaces 30*a* of the second restriction portions 30 separate from each other by a prescribed interval D, as shown in FIGS. 8 and 9. Further, the first restriction portions 29 and the second restriction portions 30 are so configured that the prescribed interval D between the upper surfaces 29*a* of the first restriction portions 29 and the upper surfaces 30*a* of the second restriction portions 30 is larger than the length L of the guide-side lock portion 22 and the base-side lock portion 12 (the pawl portions 12*a*) in the Z direction, as shown in FIG. 8. The back surface arrangement portion 27 is so configured that the vicinity of the hinge portion 28 is deflection-deformable around the first restriction portions 29 serving as the fulcrums, as shown in FIGS. 10 and 11. The guide-side lock portion 22 (the paper aligning portion 21) is configured to be upwardly movable by a distance D in the unlocked state.

The rack portion 31 is so configured that the plurality of pawl portions 31*a* are provided along the Y direction of the back surface arrangement portion 27, as shown in FIGS. 4 to 7. Further, the rack portion 31 is configured to fit with the pinion portion 13*a* (see FIG. 3) of the rotary portion 13 of the base member 1.

The recess portions 32 are provided on the side of the back surface arrangement portion 27 in the Z2 direction, as shown in FIGS. 3 and 7. Further, the recess portions 32 are provided on side of the back surface arrangement portion 27 in the X2 direction. The paper guide member 2 is so configured that the recess portions 32 are fitted with the projecting portions 13*b* of the rotary portion 13 of the base member 1 thereby inhibiting the paper guide member 2 from deviating from a position adjusted to suit to a prescribed paper size, as shown in FIG. 3.

A sliding operation of the paper guide member 2 is now described with reference to FIGS. 8 to 11. First, the grasp portion 23*b* (the lever portion 23) is inclined toward the side of the paper adjusting portion 21 (the side of the Y2 direction) in the unlocked state, as shown in FIGS. 10 and 11. At this time, the lift portion 23*a* is inclined with respect to the base member 1 following the inclination of the grasp portion 23*b*, whereby the guide-side lock portion 22 is lifted up. The contact portion 23*c* of the lift portion 23*a* coming into contact with the base member 1 when the grasp portion 23*b* inclines is arranged downward (the side of the Z2 direction) beyond the lower end of the guide-side lock portion 22. Thus, the guide-side lock portion 22 is switched from the locked state (FIGS. 8 and 9) to the unlocked state. In this unlocked state, the paper guide member 2 is slidingly moved in the Y1 direction by a user. At this time, the paper guide member 2 is slidingly moved in the Y1 direction in a state where the contact portion 23*c* of the lift portion 23*a* maintains the prescribed angle θ of inclination with respect to the base member 1 while the paper aligning portion 21, the lift portion 23*a* and the grasp portion 23*b* maintain the relative positional relation.

According to this embodiment, as hereinabove described, the guide-side lock portion 22 formed on the lower portion of the paper aligning portion 21 to be locked to the base-side lock portion 12 of the base member 11 and the lever portion 23 canceling the locked state of the guide-side lock portion 22 with respect to the base-side lock portion 12 by upwardly lifting the paper aligning portion 21 provided with the guide-side lock portion 22 and maintaining the unlocked state when the paper aligning portion 21 is slidingly moved in the unlocked state are provided. Thus, the upwardly lifted guide-side lock portion 22 can be inhibited from lowering and hitting the base-side lock portion 12 when the paper guide member 22 is slidingly moved to a side where large-sized papers are placeable, whereby the guide-side lock portion 22 and the base-side lock portion 12 can be inhibited from being caught by each other. Consequently, the paper guide member 2 can be smoothly moved to the side where large-sized papers are placeable with respect to the base member 1, and operability of the paper guide member 2 can be improved. Further, the guide-side lock portion 22 locked to the base-side lock portion 12 of the base member 1 is provided on the lower portion of the paper aligning portion 21. Thus, locking of the guide-side lock portion 22 and the base-side lock portion 12 can be inhibited from being canceled due to deformation of an elastic portion caused by a load from the papers 200 in the locked state also in a case where the number of placed papers is large or in a case where the papers are firm (stiff), dissimilarly to a case of including the guide-side lock portion 22 provided in the vicinity of the elastic portion. Thus, the paper guide member 2 can be inhibited from slipping off in the locked state.

According to this embodiment, as hereinabove described, the lever portion 23 having the lift portion 23*a* lifting up the paper aligning portion 21 provided with the guide-side lock portion 22 by inclining while coming into contact with the base member 1 and the grasp portion 23*b* grasped when inclining the lift portion 23*a* while bringing the same into contact with the base member 1 is provided, while the contact portion 23*c* is configured to be arranged downward beyond the lower end of the guide-side lock portion 22 in the unlocked state. Thus, the paper aligning portion 21 provided with the guide-side lock portion 22 can be easily upwardly lifted by moving the lift portion 23*a* downward beyond the lower end of the guide-side lock portion 22 with the lever portion 23 (the grasp portion 23*b*), whereby operability at the time of lifting up the paper aligning portion 21 can be improved. Further, the interval between the guide-side lock portion 22 of the lifted paper guide member 2 and the base-side lock portion 12 of the base member 1 can be maintained due to the contact portion 23*c* of the lift portion 23*a*, whereby the guide-side lock portion 22 and the base-side lock portion 12 can be reliably inhibited from being caught by each other.

According to this embodiment, as hereinabove described, the contact portion 23*c* of the lift portion 23*a* is arranged on the position separating to the outer side opposite to the side of the paper aligning portion 21 coming into contact with the papers 200 beyond the guide-side lock portion 22. Thus, force in a sliding movement direction applied to the paper aligning portion 21 can be received by the contact portion 23*c* of the lift portion 23*a* when slidingly moving the paper aligning portion 22 to the outer side opposite to the side of the paper aligning portion 21 coming into contact with the papers 200 beyond the guide-side lock portion 22, whereby the guide-side lock portion 22 can be effectively inhibited from lowering and hitting the base-side lock portion 12.

According to this embodiment, as hereinabove described, the grasp portion 23*b* is so configured that the same is opposed to the paper aligning portion 21 in the locked state and the upper portion inclines in the direction approaching the paper aligning portion 21 to come into contact with the paper aligning portion 21 in the unlocked state, while the guide-side lock portion is configured to be lifted up through such an operation that the lift portion 23*a* coming into contact with the base member 1 inclines following the inclination of the grasp portion 23*b*. Thus, the paper guide member 2 is slidingly moved while the state where the contact portion 23*c* of the lift portion 23*a* inclines by the prescribed angle of inclination with respect to the base member 1 at the time when the guide-side lock portion 22 is lifted up is maintained, whereby the interval between the lifted guide-side lock portion 22 and the base-side lock portion 12 can be more reliably maintained also at the time of slidingly moving the paper guide member 2. Consequently, the guide-side lock portion 22 and the base-side lock portion 12 can be more reliably inhibited from being caught by each other.

According to this embodiment, as hereinabove described, the paper guide member 2 is configured to be slidingly movable in the state where the contact portion 23*c* maintains the prescribed angle of inclination with respect to the base member 1 while the paper aligning portion 21, the lift portion 23*a* and the grasp portion 23*b* maintain the relative positional relation in the unlocked state. Thus, the paper guide member 2 is slidingly moved while the state where the contact portion 23*c* of the lift portion 23*a* inclines by the prescribed angle of inclination with respect to the base member 1 and the relative positional relation between the paper aligning portion 21, the lift portion 23*a* and the grasp portion 23*b* at the time when the guide-side lock portion 22 is lifted up are maintained, whereby the interval between the lifted guide-side lock portion 22 and the base-side lock portion 12 can be further reliably maintained also at the time of slidingly moving the paper guide member 2. Thus, the guide-side lock portion 22 and the base-side lock portion 12 can be further reliably inhibited from being caught by each other.

According to this embodiment, as hereinabove described, the paper aligning portion 21, the grasp portion 23*b* and the lift portion 23*a* are configured to have thicknesses substantially undeformed in the unlocked state. Thus, the paper guide member 22 can be slidingly moved in a state where the state where the contact portion 23*c* of the lift portion 23*a* inclines by the prescribed angle θ of inclination with respect to the base member 1 and the relative positional relation between the paper aligning portion 21, the lift portion 23*a* and the grasp portion 23*b* at the time when the guide-side lock portion 22 is lifted up are reliably maintained.

According to this embodiment, as hereinabove described, the guide-side lock portion 22 is so configured that the forward end has the prescribed angle θ0 and functions as the guide-side pawl portion, while the lift portion 23*a* is configured to incline by the angle θ smaller than the prescribed angle θ0 of the guide-side pawl portion with respect to the base member 1 in the unlocked state. Thus, the lift portion 23*a* can be inhibited from excessively inclining with respect to the base member 11 in the unlocked state, whereby the lift portion 23*a* (the lever portion 23) can be inhibited from being caught by the base member 1 when slidingly moving the paper guide member 2.

According to this embodiment, as hereinabove described, the upwardly lifted paper aligning portion 21 is configured to be arranged on the height position where the guide-side lock portion 22 does not come into contact with the pawl portions 12*a* of the base-side lock portion 12 in the unlocked state. Thus, the lifted guide-side lock portion 22 (the guide-side pawl portion) and the base-side lock portion 12 (the pawl portions 12*a*) can be reliably inhibited from being caught by each other when slidingly moving the paper guide member 2.

According to this embodiment, as hereinabove described, the grasp portion 23*b* is configured to shift the locked state to the unlocked state by inclining toward the side of the paper aligning portion 21 while bringing the lift portion 23*a* into contact with the base member 1. Further, the grasp portion 23*b* is configured to shift the unlocked state to the locked state by being separated from the side of the paper aligning portion 21 and arranged substantially perpendicularly with respect to the base member 1. Thus, the unlocked state and the locked state can be easily switched by changing the inclined state of the grasp portion 23*b* with respect to the paper aligning portion 21.

According to this embodiment, as hereinabove described, the lever portion 23 is formed substantially in an L shape, the connecting portions 24 connecting the substantially L-shaped lever portion 23 and the paper aligning portion 21 with each other are provided on the paper guide member 2, the torsion-deformable lever support portions 25 pivotably supporting the lever portion 23 are provided on the regions of the connecting portions 24 in the vicinity of the lever portion 23, and the lift portion 23*a* is configured to pivot and incline to lift up the paper aligning portion 21 on the lever support portions 25 in the unlocked state. Thus, the lever portions 23 can be easily inclined (pivoted) by torsion-deforming the lever support portions 25, whereby the paper aligning portion 21 provided with the guide-side lock portion 22 on the lower portion can be more easily upwardly lifted.

According to this embodiment, as hereinabove described, the surface of the lift portion 23*a* on the side of the base member 1 is formed in a plate shape substantially in the form of a planar surface. Thus, friction between the surface of the lift portion 23*a* on the side of the base member 1 and the base member 1 can be reduced, whereby the paper guide member 2 can be smoothly slidingly moved.

According to this embodiment, as hereinabove described, the pair of lever support portions 25 are configured to hold the lever portion 23 therebetween in plan view. Thus, the lever portion 23 can be inclined in a stable state by torsion-deforming the pair of lever support portions 25.

According to this embodiment, as hereinabove described, the lever support portions 25 are configured to have the width smaller than the width of the connecting portions 24 in plan view. Thus, the lever support portions 25 can be easily torsion-deformed, whereby the lever portion 23 can be more easily inclined.

According to this embodiment, as hereinabove described, the paper guide member 2 is formed by resin, and the paper aligning portion 21, the connecting portions 24 and the lever portion 23 are integrally formed. Thus, increase in the number of components can be suppressed, dissimilarly to a case of providing the paper aligning portion 21, the connecting portions 24 and the lever portion 23 separately from each other respectively. Further, the paper aligning portion 21, the connecting portions 24 and the lever portion 23 can be easily simultaneously integrally formed by resin formation.

According to this embodiment, as hereinabove described, the load portion 26 and the back surface arrangement portion 27 provided to couple to the load portion 26 are provided on the paper guide member 2, while the deflection-deformable hinge portion 28 is provided in the vicinity of the boundary between the back surface arrangement portion 27 and the load portion 26. When structuring the printer device 100 in this manner, the paper aligning portion 21 provided with the guide-side lock portion 22 on the lower portion can be easily upwardly lifted by deflecting a vicinity of the hinge portion 28 of the back surface arrangement portion 27.

According to this embodiment, as hereinabove described, the back surface arrangement portion 27 is formed in the horizontally long shape extending in the direction where the paper aligning portion 21 slidingly moves, while parts of the lift portion 23*a* and the grasp portion 23*b* are arranged to overlap with the back surface arrangement portion 27 in the short-side direction (the X direction) of the back surface arrangement portion 27 of the horizontally long shape. Thus, the back surface arrangement portion 27 can be inhibited from getting distorted around the straight line 500 passing through the back surface arrangement portion 27 and substantially parallel to the extensional direction of the back surface arrangement portion 27, dissimilarly to a case where the lift portion 23*a* and the grasp portion 23*b* are arranged on positions remarkably separating from the back surface arrangement portion 27 in the short-side direction of the back surface arrangement portion 27. Thus, the vicinity of the hinge portion 28 of the back surface arrangement portion 27 can be easily upwardly deflected.

According to this embodiment, as hereinabove described, the first restriction portions 29 and the second restriction portions 30 capable of restricting lifting of the paper aligning portion 21 provided with the guide-side lock portion 22 beyond the prescribed height are provided on the back surface arrangement portion 27, the first restriction portions 29 are formed on the positions closer to the hinge portion 28 than the second restriction portions 30, and the upper surfaces 29*a* of the first restriction portions 29 are arranged upward beyond the upper surfaces 30*a* of the second restriction portions 30. Thus, the back surface arrangement portion 27 can be inhibited from breakage due to excessive upward lifting of the paper aligning portion 21 through the first restriction portions 29 and the second restriction portions 30. Further, the paper aligning portion 21 is upwardly lifted by the difference between the heights of the upper surfaces 29*a* of the first restriction portions 29 and the upper surfaces 30*a* of the second restriction portions 30, whereby the quantity of lifting of the paper aligning portion 21 can be easily restricted.

According to this embodiment, as hereinabove described, the first restriction portions 29 are configured to come into contact with the base member 1 in the locked state and the unlocked state, the second restriction portions 30 are arranged on the positions between the first restriction portions 29 and the guide-side lock portion 22 (the guide-side pawl portion) in the direction where the paper aligning portion 21 slidingly moves, and the interval D between the upper surfaces of the first restriction portions 29 and the upper surfaces of the second restriction portions 30 is configured to be larger than the length L of the pawl portions 12*a* in the vertical direction. Thus, the paper aligning portion 21 can be easily upwardly lifted by the difference between the heights of the upper surfaces of the first restriction portions 29 and the upper surfaces of the second restriction portions 30 by employing the first restriction portions 29 as the fulcrums, dissimilarly to a case where the second restriction portions 30 are arranged on a side opposite to the first restriction portions 29 beyond the guide-side lock portion 22 (the guide-side pawl portion).

According to this embodiment, as hereinabove described, the first restriction portions 29 and the second restriction portions 30 are formed integrally with the back surface arrangement portion 27. When structuring the printer device 100 in this manner, the number of components can be reduced, dissimilarly to a case of structuring the first restriction portions 29 and the second restriction portions 30 separately from the back surface arrangement portion 27.

The embodiment disclosed this time must be considered as illustrative in all points and not restrictive. The range of the present invention is shown not by the above description of the embodiment but by the scope of claims for patent, and all modifications within the meaning and range equivalent to the scope of claims for patent are included.

For example, while the example of applying the paper guiding mechanism and the image forming device according to the present invention to the printer device has been shown in the aforementioned embodiment, the present invention is not restricted to this. The present invention may be applied to a paper guiding mechanism and an image forming device other than the printer device. For example, the present invention may be applied to a paper guiding mechanism such as a scanner, or an image forming device such as a facsimile.

While the example of canceling the locked state and maintaining the unlocked state with the lever portion (the unlocking maintaining portion) has been shown in the aforementioned embodiment, the present invention is not restricted to this. According to the present invention, the locked state may be canceled and the unlocked state may be maintained with an unlocking maintaining portion other than the lever portion.

While such an example that the section of the lever portion (the unlocking maintaining portion) has the substantially L shape has been shown in the aforementioned embodiment, the present invention is not restricted to this. According to the present invention, the section of the unlocking maintaining portion may have a substantially triangular shape, for example, other than the substantially L shape. Thus, rigidity of the unlocking maintaining portion can be further increased, whereby force applied to the paper aligning portion can be reliably received when the paper guide member is slidingly moved. Consequently, the lifted guide-side lock portion can be further reliably inhibited from lowering.

While such an example that the paper aligning portion, the connecting portions and the lever portion (the unlocking maintaining portion) are integrally formed by resin has been shown in the aforementioned embodiment, the present invention is not restricted to this. According to the present invention, the paper aligning portion, the connecting portions and the unlocking maintaining portion may not be integrally formed.

While the example of forming the hinge portion by lessening the width of the back surface arrangement portion in the anteroposterior direction (the X direction) has been shown in the aforementioned embodiment, the present invention is not restricted to this. According to the present invention, the hinge portion may be formed by lessening the width of the back surface arrangement portion in the vertical direction (the Z direction).

While the example of providing one guide-side lock portion has been shown in the aforementioned embodiment, the present invention is not restricted to this. According to the present invention, at least two guide-side lock portions may be provided.

DESCRIPTION OF REFERENCE SIGNS

1 base member
2 paper guide member
3 developing device (printing portion)
11 placing surface
12 base-side lock portion
12*a* pawl portion (base-side pawl portion)
21 paper aligning portion
22 guide-side lock portion
23 lever portion (unlocking maintaining portion)
23*a* lift portion (unlocking maintaining portion)
23*b* grasp portion (unlocking maintaining portion)
23*c* contact portion
24 connecting portion
25 lever support portion
26 load portion
27 back surface arrangement portion
28 hinge portion
29 first restriction portion
30 second restriction portion
100 printer device (image forming device)
110 paper guiding mechanism
200 paper

The invention claimed is:

1. An image forming device comprising:

a paper feed tray including a first lock portion, on which a medium is placed, a paper feeder guide guiding the medium and movable in a prescribed direction on the paper feed tray, wherein the paper feeder guide includes a guide portion, connecting portions and a lever portion, the lever portion has outer side edges located on opposite sides of the lever portion in a direction perpendicular to the prescribed direction, the guide portion has a guide surface guiding the medium and a second lock portion engaging the first lock portion, the connecting portions connecting the guide portion and the lever portion to each other, the connecting portions include a first connecting portion connected to one of the outer side edges of the lever portion and a second connecting portion connected to the other outer side edge of the lever portion on the opposite side of the lever portion, and the first and second connecting portions are arranged with respect to the lever portion on the outer side edges of the lever portion, the lever portion has a first side end extending toward the guide portion, and a second side end extending in a direction away from the paper feed tray, and the second side end is movable toward the guide portion by rotating the lever portion on the connecting portions, and an engaged state of the first lock portion and the second lock portion is released on the basis of the first side end of the lever portion contacting with the paper feed tray during the rotating of the lever portion.

2. The image forming device according to claim 1, wherein the lever portion is arranged on an opposite side with respect to the guide surface of the guide portion.

3. The image forming device according to claim 2, wherein the first side end is contacted with the paper feed tray by inclining the lever portion, the engaged state of the first lock portion and the second lock portion is released by lifting the guide portion with the connecting portions.

4. The image forming device according to claim 3, wherein the guide portion and the connecting portions have thicknesses substantially undeformed in a state of releasing the engagement of the first lock portion and the second lock portion.

5. The image forming device according to claim 1, wherein the second lock portion has a convex portion, and the convex portion of the second lock portion has an inclining surface on a side of the guide portion.

6. The image forming device according to claim 5, wherein the first lock portion has an inclining surface opposite to the inclining surface of the second lock portion.

7. The image forming device according to claim 5, wherein the convex portion has a length that separates the convex portion from the paper feed tray by a prescribed length when the lever portion contacts with the guide portion at an angle during the rotating of the lever portion.

8. The image forming device according to claim 1, wherein the lever portion is substantially L-shaped.

9. The image forming device according to claim 1, wherein the second lock portion is formed in a bottom surface of the guide portion.

10. The image forming device according to claim 3, wherein the guide portion is inclined by lifting the guide portion by the connecting portions.

11. The image forming device according to claim 10, wherein an inclined angle of a bottom surface of the guide portion relative to a plane along uppermost surfaces of the first lock portion is smaller than an inclined angle of a bottom surface of the lever portion relative to the plane when the first side end of the lever portion contacts with the paper feed tray during the rotating of the lever portion.

12. The image forming device according to claim 1, wherein the guide portion, the connecting portions and the lever portion are integrally formed.

13. The image forming device according to claim 1, wherein the paper feeder guide further includes a load portion provided adjacently to the guide portion to be loaded with the medium and a back surface arrangement portion provided to couple to the load portion and arranged on a back surface of the paper feed tray, and a hinge portion deflection-deformable in a direction for upwardly lifting the load portion and the guide portion is provided in the vicinity of the boundary between the back surface arrangement portion and the load portion.

14. The image forming device according to claim 13, wherein the back surface arrangement portion has a horizontally long shape extending in a direction where the guide portion slidingly moves, and at least parts of the first side end and the second side end are arranged to overlap with the back surface arrangement portion in a short-side direction of the back surface arrangement portion having the horizontally long shape.

15. The image forming device according to claim 13, wherein the back surface arrangement portion includes a first restriction portion and a second restriction portion capable of restricting lifting of the guide portion beyond a prescribed height by coming into contact with the back surface, the first restriction portion is formed on a position closer to the hinge portion than the second restriction portion, and an upper surface of the first restriction portion is arranged upward beyond an upper surface of the second restriction portion.

16. The image forming device according to claim 15, wherein the first lock portion includes a base-side pawl portion, the second lock portion includes a guide-side pawl portion, the first restriction portion comes into contact with the paper feed tray in the engaged state and a state of releasing the engaged state, the second restriction portion is arranged on a position between the first restriction portion and the guide-side pawl portion in a direction where the guide portion moves, and the interval between the upper surface of the first restriction portion and the upper surface of the second restriction portion is larger than the length of the base-side pawl portion in the vertical direction.

17. The image forming device according to claim 15, wherein the first restriction portion and the second restriction portion are formed integrally with the back surface arrangement portion.

* * * * *